US011242648B2

(12) United States Patent
Bixby et al.

(10) Patent No.: US 11,242,648 B2
(45) Date of Patent: Feb. 8, 2022

(54) REMOVABLE BASKET FOR LAUNDRY APPLIANCE

(71) Applicant: WHIRLPOOL CORPORATION, Benton Harbor, MI (US)

(72) Inventors: Seth E. Bixby, Stevensville, MI (US); Sayer J. Murphy, St. Joseph, MI (US); Kartik Sadanand Vastrad, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 107 days.

(21) Appl. No.: 16/668,238

(22) Filed: Oct. 30, 2019

(65) Prior Publication Data

US 2020/0208340 A1 Jul. 2, 2020

Related U.S. Application Data

(60) Provisional application No. 62/785,822, filed on Dec. 28, 2018.

(51) Int. Cl.

| | |
|---|---|
| ***D06F 95/00*** | (2006.01) |
| ***D06F 37/24*** | (2006.01) |
| ***D06F 37/12*** | (2006.01) |
| ***D06F 37/26*** | (2006.01) |
| ***D06F 31/00*** | (2006.01) |
| ***D06F 21/08*** | (2006.01) |

(52) U.S. Cl.

CPC ..... *D06F 95/002* (2013.01); *D06F 21/08* (2013.01); *D06F 31/00* (2013.01); *D06F 37/12* (2013.01); *D06F 37/24* (2013.01); *D06F 37/267* (2013.01); *D06F 95/008* (2013.01)

(58) Field of Classification Search

CPC ..... D06F 95/002; D06F 31/00; D06F 21/08; D06F 37/12; D06F 37/24; D06F 37/267; D06F 95/008

See application file for complete search history.

(56) References Cited

U.S. PATENT DOCUMENTS

| | | | | |
|---|---|---|---|---|
| 2,645,914 A * | 7/1953 | Sessions | D06F 31/005 68/10 |
| 3,029,623 A | 4/1962 | Morey | |
| 3,091,107 A | 5/1963 | Rhodes | |
| 3,324,688 A | 6/1967 | Hubbard | |
| 3,481,162 A * | 12/1969 | Ziegler | D06F 13/00 68/4 |
| 3,575,020 A | 4/1971 | Hubbard | |
| 4,175,409 A | 11/1979 | Morey | |
| 4,637,230 A | 1/1987 | Roberts | |
| 5,907,961 A * | 6/1999 | Lee | D06B 3/30 68/140 |
| 6,588,238 B1 * | 7/2003 | Reason | D06F 37/10 68/24 |

(Continued)

FOREIGN PATENT DOCUMENTS

WO 2017188755 A1 2/2017

*Primary Examiner* — Joseph L. Perrin
(74) *Attorney, Agent, or Firm* — Price Heneveld LLP

(57) ABSTRACT

A laundry appliance including a cabinet that defines an opening to access an interior. A drum is positioned within the interior of the cabinet. A removable basket is selectively coupled to the drum and includes a first arcuate body that is coupled with a second arcuate body. The second arcuate body is rotatable between a nested position and an expanded position.

20 Claims, 13 Drawing Sheets

(56) References Cited

U.S. PATENT DOCUMENTS

| | | | | |
|---|---|---|---|---|
| 6,732,553 | B2 * | 5/2004 | Rhode | D06F 37/08 68/20 |
| 7,401,479 | B2 | 7/2008 | Fields | |
| 7,404,303 | B1 * | 7/2008 | Barbosa | D06F 37/10 68/3 R |
| 9,611,581 | B2 | 4/2017 | Seo et al. | |
| 9,777,419 | B2 | 10/2017 | Bergamo | |
| 9,863,078 | B2 | 1/2018 | Ramasco et al. | |
| 10,458,054 | B1 * | 10/2019 | Hamilton | D06F 29/00 |
| 2004/0231063 | A1 * | 11/2004 | Rhode | D06F 58/04 8/159 |
| 2013/0115130 | A1 * | 5/2013 | Kappler | D06F 58/20 422/5 |
| 2015/0211163 | A1 * | 7/2015 | Kim | D06F 37/30 68/133 |
| 2018/0209084 | A1 * | 7/2018 | Chakravarty | D06F 58/04 |

* cited by examiner

REMOVABLE BASKET FOR LAUNDRY APPLIANCE

CROSS-REFERENCE TO RELATED APPLICATION

This application claims priority to and the benefit under 35 U.S.C. § 119(e) of U.S. Provisional Patent Application No. 62/785,822, filed on Dec. 28, 2018, entitled "REMOVABLE BASKET FOR LAUNDRY APPLIANCE," the entire disclosure of which is hereby incorporated herein by reference.

FIELD OF THE DISCLOSURE

The present disclosure generally relates to a laundry basket and, more specifically, a removable laundry basket for a washer.

BACKGROUND OF THE DISCLOSURE

When doing laundry, many people prefer to separate their clothes based on type of clothing (e.g., whites, darks, or delicates). However, often times people do not have enough laundry to form multiple, full loads of laundry. This often results in separate smaller loads of laundry. Smaller baskets have been used to address these issues.

SUMMARY

According to at least one aspect of the present disclosure, a laundry appliance includes a cabinet that defines an opening to access an interior. A drum is positioned within the interior of the cabinet. A removable basket is selectively coupled to the drum and includes a first arcuate body that is coupled with a second arcuate body. The second arcuate body is rotatable between a nested position and an expanded position.

According to another aspect of the present disclosure, a removable basket for a laundry appliance includes a first arcuate body. A base is coupled to the first arcuate body. A second arcuate body is rotatably coupled to the first arcuate body. The second arcuate body rotates between a nested position and an expanded position. A fastening assembly is coupled to at least one of the first and second arcuate bodies to retain the second arcuate body in the expanded position.

According to another aspect of the present disclosure, a method for installing a removable basket within a laundry appliance includes providing a removable basket that has a first arcuate body rotatably coupled to a second arcuate body. The removable basket is inserted into a drum when the removable basket is in a nested position. The first arcuate body is coupled to an attachment feature. The second arcuate body is rotated from the nested position to an expanded position. The second arcuate body is coupled to the attachment feature.

These and other features, advantages, and objects of the present device will be further understood and appreciated by those skilled in the art upon studying the following specification, claims, and appended drawings.

DETAILED DESCRIPTION OF EMBODIMENTS

Figure 1:
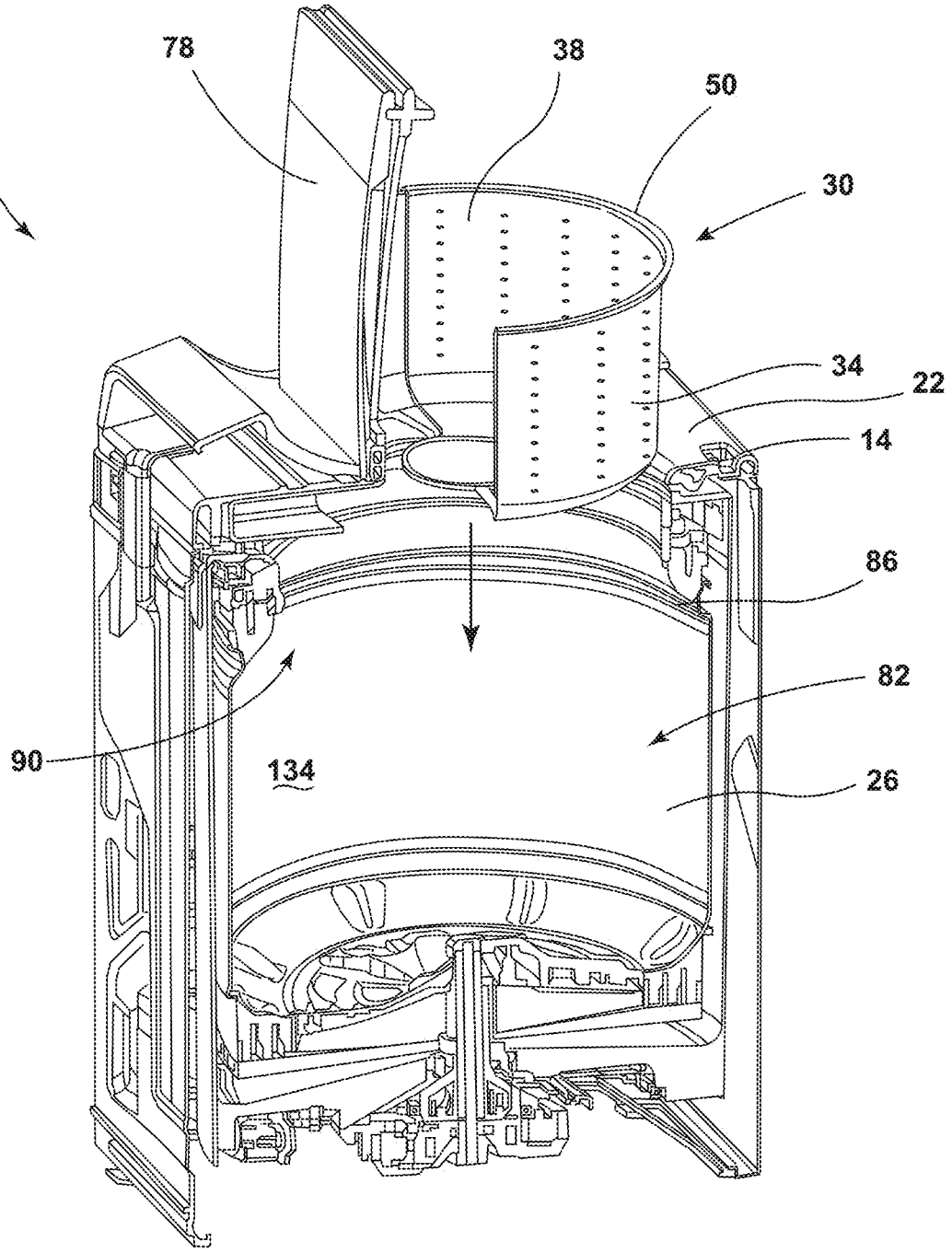
FIG. 1 is a cross-sectional view of a vertical-axis laundry appliance having a drum and a removable basket, according to at least one example.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-13, reference numeral 10 generally designates a laundry appliance having a cabinet 14 that defines an opening 18 on a top panel 22. The laundry appliance 10 includes a drum 26 positioned therein and a removable basket 30. The removable basket 30 includes a first arcuate body 34 rotatably coupled to a second arcuate body 38. The laundry appliance 10 includes a first agitator 42 coupled to a bottom surface 46 of the drum 26. Typically, the laundry appliance 10 is a vertical-axis and/or top-load washer. However, it will be contemplated that the removable basket 30 can be used with other types of laundry appliances 10.

Figure 2:
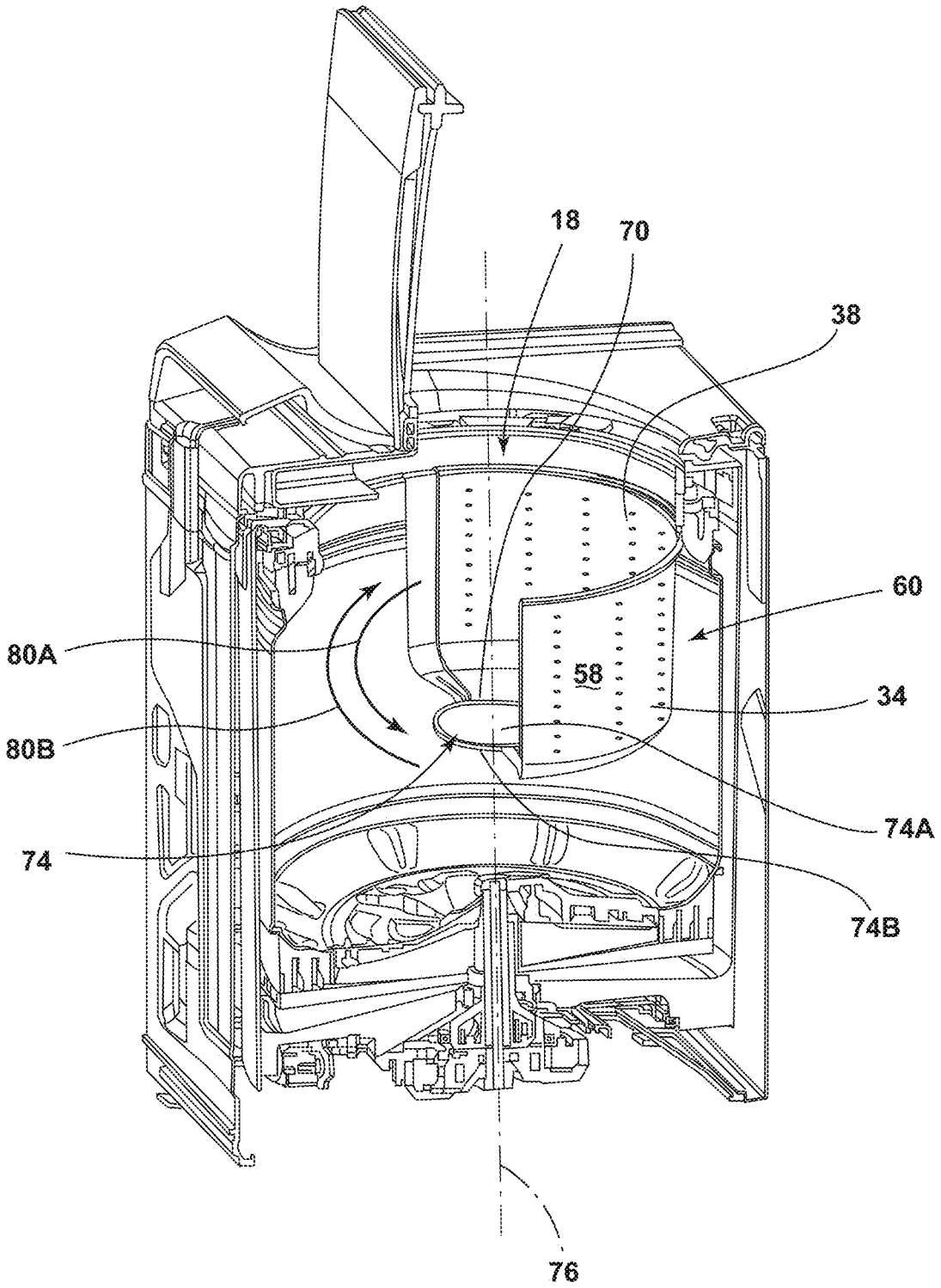
FIG. 2 is a cross-sectional view of the vertical-axis laundry appliance of FIG. 1 showing the removable basket in a nested position.
Figure 3:
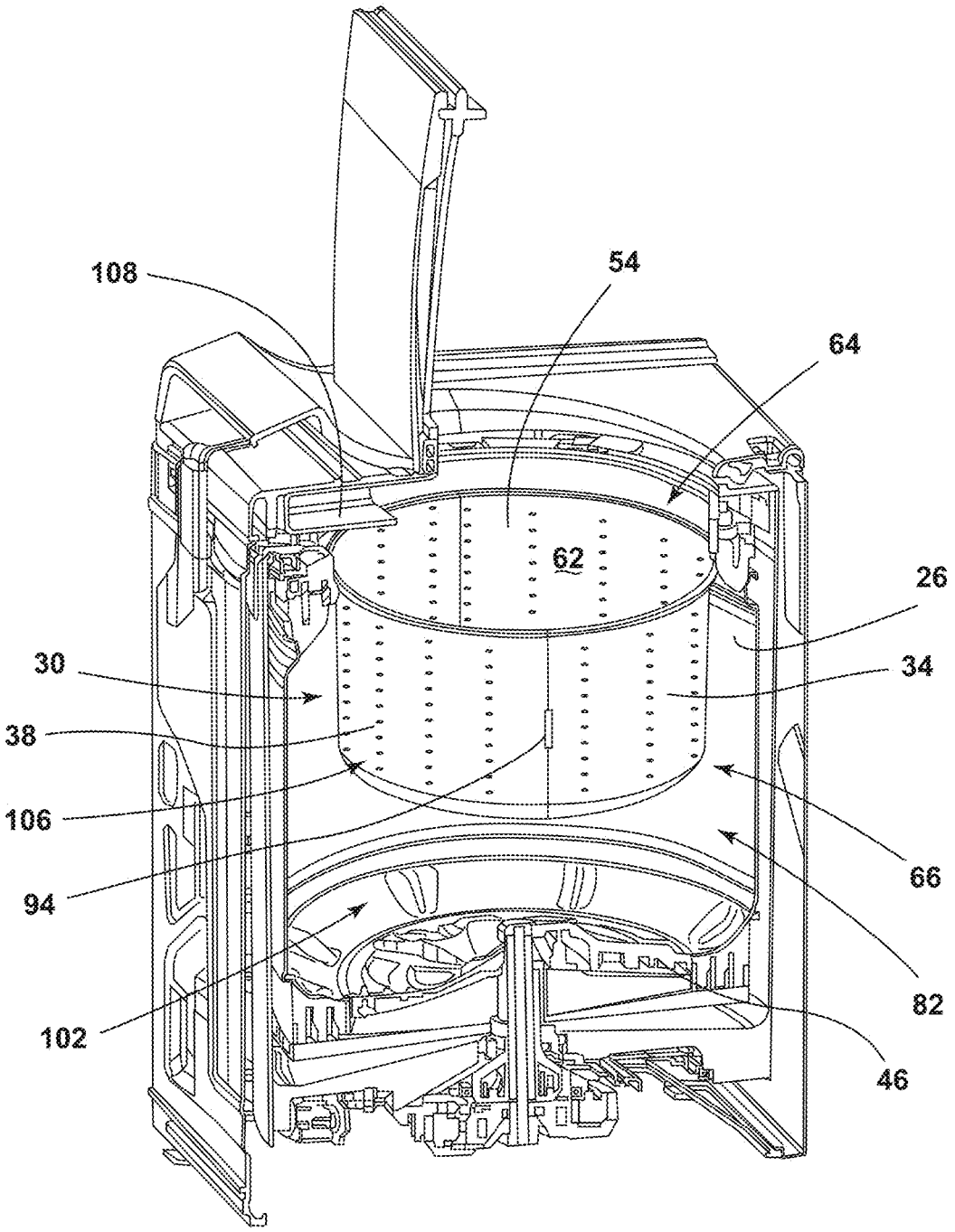
FIG. 3 is a cross-sectional view of the vertical-axis laundry appliance of FIG. 1 having the removable basket in an expanded position.

With reference to FIGS. 1-3, the removable basket 30 is illustrated in various positions with respect to the drum 26. The removable basket 30 includes the first and second arcuate bodies 34, 38 that at least partially overlap. In such examples, the second arcuate body 38 can include a lip 50 configured to couple to a top edge portion 54 of the first arcuate body 34. The lip 50 is configured to extend over a top edge portion 54 to an exterior surface 58 of the first arcuate body 34. In various examples, the first and second arcuate bodies 34, 38 can completely overlap when in a nested position 60, such that the first and second arcuate bodies 34, 38 appear as a single arcuate body with the second arcuate body 38 positioned on an interior surface 62 of the first arcuate body 34, or vice versa. In this way, the interior surface 62 of the first arcuate body 34 can abut the exterior surface 58 of the second arcuate body 38 at least when in the nested position 60. In a non-limiting example, an exterior surface 58 of the second arcuate body 38 overlaps with the interior surface 62 of the first arcuate body 34.

The first and second arcuate bodies 34, 38 form a cylindrical or frusto-conical shape when in an expanded position 64, as shown in FIG. 3. In such examples, the first and second arcuate bodies 34, 38 form a substantially continuous sidewall 66 and a base 70 configured to hold laundry. Stated differently, the second arcuate body 38 can be rotatably coupled to the first arcuate body 34. The second arcuate body 38 is operable between the nested position 60 (FIG. 2) and the expanded position 64 (FIG. 3). Typically, the second arcuate body 38 partially overlaps the first arcuate body 34 when in the expanded position 64. In this way, the sidewall 66 is a substantially continuous surface without a significant gap defined between the first and second arcuate bodies 34, 38.

In various examples, the first arcuate body 34 is fixedly coupled to a center support 74. In such examples, the second arcuate body 38 is rotatably coupled to the center support 74, such that the second arcuate body 38 can rotate about a rotational axis 76 of the removable basket 30, which when installed within the rotating drum 26, typically aligns with a vertical axis of the drum 26. The rotation of the second arcuate body 38 can be guided by a perimeter of the center support 74. For example, the center support 74 can guide the rotation of the second arcuate body 38. In other words, the second arcuate body 38 is rotatably coupled to the center support 74, such that the second arcuate body 38 can move about the perimeter of the center support 74 between the nested position 60 and the expanded position 64. In various examples, the second arcuate body 38 is typically configured to rotate approximately 180°. In this way, the second arcuate body 38 rotates in a first direction 80A from the nested position 60 to the expanded position 64 and then returns in an opposing second direction 80B to the nested position 60. Alternatively, the second arcuate body 38 may be configured to rotate 360° clockwise and/or counter-clockwise. In such examples, the second arcuate body 38 rotates in a single direction from the nested position 60 to the expanded position 64 and back to the nested position 60. It is contemplated that the first arcuate body 34 can be rotatable where the second arcuate body 38 is fixed, without departing from the teachings herein.

In various examples, the center support 74 can include a top support 74A and a bottom support 74B. In such examples, the bottom support 74B is coupled to the first arcuate body 34 and the top support 74A is coupled to the second arcuate body 38. The top and bottom supports 74A, 74B are rotatably coupled together to allow the removable basket 30 to move between the nested and expanded positions 60, 64.

With further reference to FIGS. 1-3, the removable basket 30 can be inserted and/or removed from the drum 26 via the opening 18 when a door 78 of the laundry appliance 10 is opened. The door 78 is operable between closed and opened positions when the removable basket 30 is positioned within an interior 82 of the drum 26 and/or when the removable basket 30 is positioned in a location exterior of the laundry appliance 10. In operation, a user can insert the removable basket 30 into the drum 26 when the removable basket 30 is in the nested position 60. The opening 18 of the laundry appliance 10 is typically "D"-shaped and can be smaller than the removable basket 30 in the expanded position 64. Moreover, the opening 18 is typically offset with respect to the rotational axis (e.g., the vertical axis) of the drum 26. Accordingly, the nested position 60 of the removable basket 30 is configured to substantially and proportionally match the shape of the opening 18 to allow for convenient insertion of the removable basket 30 through the opening 18 and into the drum 26. Once the removable basket 30 is positioned in the drum 26, the removable basket 30 can be rotated to the expanded position 64. Additionally, when in the expanded position 64, a central axis (e.g., the rotational axis 76) of the removable basket 30 aligns with the rotational axis of the drum 26.

In various examples, the removable basket 30 is selectively coupled to an attachment feature 86 positioned proximate an upper portion 90 of the drum 26. In such examples, the first arcuate body 34 includes a portion of the lip 50, which is configured to cooperate with the attachment feature 86. Once the first arcuate body 34 is coupled with the attachment feature 86, the second arcuate body 38 is rotated about the center support 74. The portion of the lip 50 provided on the second arcuate body 38 is configured to cooperate with the attachment feature 86 to couple the second arcuate body 38 to the attachment feature 86. Accordingly, when the second arcuate body 38 is rotated, the removable basket 30 is in the expanded position 64 where the removable basket 30 includes the substantially continuous sidewall 66 and the base 70 to form a cylindrical shape or a frusto-conical shape. Additionally, the lip 50 forms a substantially continuous upper rim of the removable basket 30 that engages the attachment feature 86.

The first and second arcuate bodies 34, 38 typically includes a retaining assembly 94. The retaining assembly 94 may be positioned on the first arcuate body 34, the second arcuate body 38, and/or a combination thereof. In various examples, the retaining assembly 94 secures the first and second arcuate bodies 34, 38 in the expanded position 64. It is advantageous to include the retaining assembly 94 to prevent the second arcuate body 38 from rotating during use of the removable basket 30 during the laundry cycle (e.g., wash, spin, etc.). However, it is contemplated that the removable basket 30 may remain stationary during the laundry cycle. Additionally, it is contemplated that the removable basket 30, while in the expanded position, may be configured to rotate independently, or rotate in conjunction with the drum 26 or the first agitator 42 that rotates within the drum 26. Further, the retaining assembly 94 secures the first and second arcuate bodies 34, 38 together in the nested position 60 to prevent movement of the second arcuate body 38 as a user is inserting and/or removing the removable basket 30 from the laundry appliance 10. The retaining assembly 94 may be in the form of, for example, a latch, hook, mating assembly, detent, interlock, combinations thereof, or other similar operable connective engagement between the first and second arcuate bodies 34, 38.

Referring to FIG. 3, when the removable basket 30 is positioned fully within the interior 82 of the drum 26, the removable basket 30 can be spaced-apart from the bottom surface 46 of the drum 26. Having a space 102 defined between the removable basket 30 and the bottom surface 46 of the drum 26 is advantageous to allow the user to wash two separate loads of laundry contemporaneously. In such embodiments, the user can have one load of laundry in the drum 26 and a separate load of laundry in the removable basket 30. In various non-limiting examples, the removable basket 30 can have a total volume of within a range from about 0.25 cubic feet to about 1.5 cubic feet. In the depicted example shown in FIGS. 1-5, the removable basket 30 has a volume of about 1.25 cubic feet. These volumetric measurements are exemplary in nature and will vary depending on the size and/or shape of the removable basket 30 and the laundry appliance 10.

During use, the removable basket 30 may be partially submerged in water that fills the drum 26 during the laundry cycle. In such examples, a bottom portion 106 of the removable basket 30 is submerged in fluids (e.g., water, laundry chemistry, etc.). In the depicted non-limiting example, the removable basket 30 has a submerged volume of about 0.6 cubic feet, where the submerged volume is the volume of the removable basket 30 submerged in the fluids that fill the drum 26 during the laundry cycle. It is contemplated that the total volume and the submerged volume may be greater or lesser based on the size of the removable basket 30, the size of the laundry appliance 10, and/or model of the laundry appliance 10. The fluids can enter the removable basket 30 in various ways. For example, at the start of a wash cycle, water and other fluids can enter the removable basket 30 from a fill mechanism 108 positioned proximate to the upper portion 90 of the drum 26. Additionally or alternatively, the fluids within the drum 26 can enter the removable basket 30 through at least slit 118 or aperture 122 (FIG. 5) defined by the bottom portion 106 and/or the sidewall 66 of the first and/or second arcuate bodies 34, 38.

Figure 4:
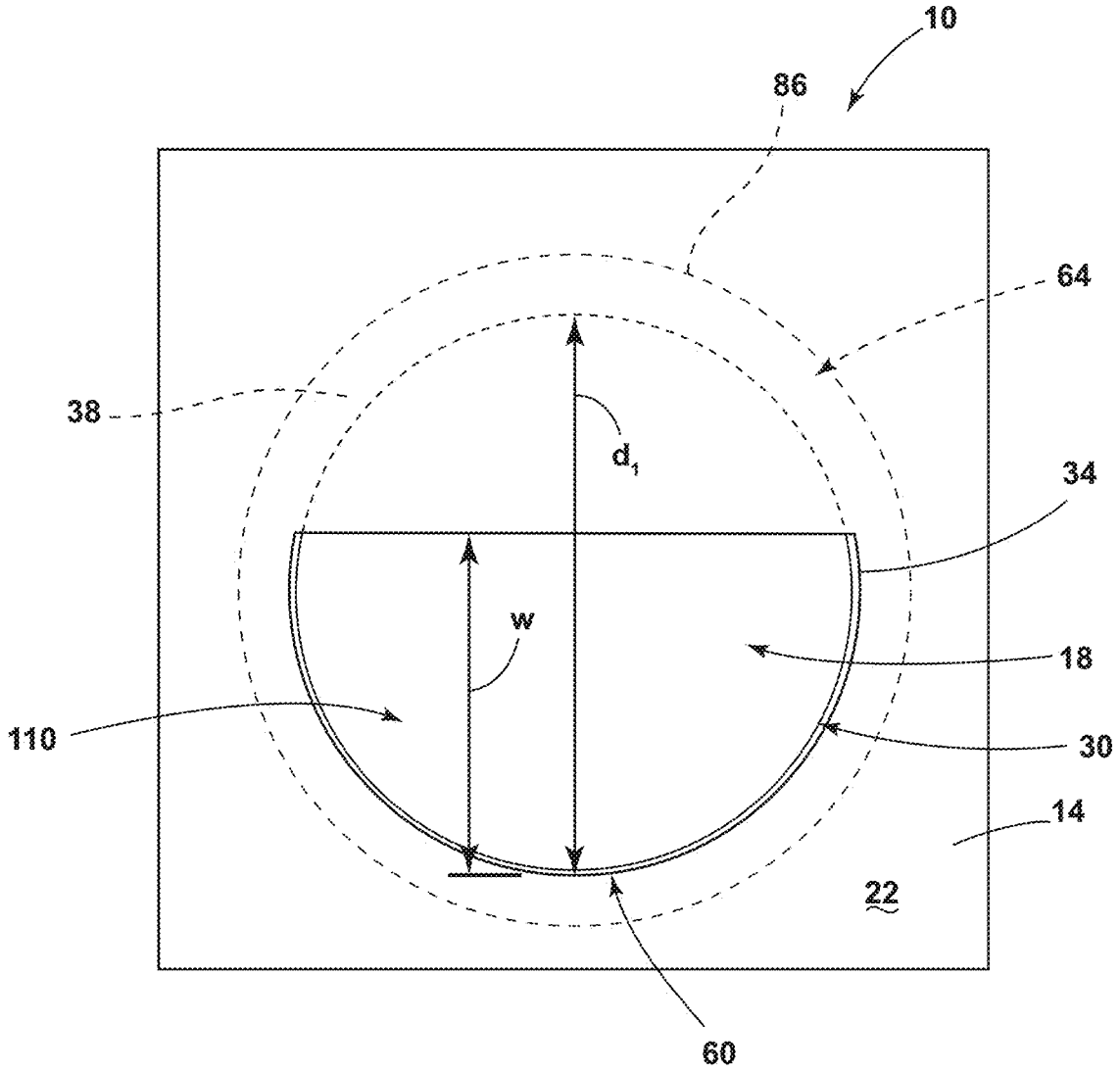
FIG. 4 is a schematic top view of a laundry appliance, according to at least one example.

Referring to FIG. 4, the removable basket 30 often has a diameter $d_1$ that is greater than a width w of the opening 18. In such examples, the user inserts the removable basket 30 through the opening 18 and into the drum 26 while the removable basket 30 is in the nested position 60 (FIG. 2). Then, the user can couple the first arcuate body 34 to the attachment feature 86. The attachment feature 86 is positioned under the top panel 22 of the cabinet 14. Additionally, the second arcuate body 38 can be rotated to the expanded position 64 thereby creating a cavity 110 wider than the opening 18 of the laundry appliance 10. It is advantageous to have the width w of the opening 18 be lesser than the diameter $d_1$ of the removable basket 30 to allow the laundry appliance 10 to have a large display on the laundry appliance 10 and a large volume within the drum 26 and the removable basket 30.

In various examples, the removable basket 30 can be formed from the same and/or similar materials as the drum 26 (FIG. 1). In such examples, the removable basket 30 may be formed from, for example, plastics, metals, and/or metal alloys. The removable basket 30 can also be formed of steel, stainless steel, and/or be porcelain coated. It is contemplated that the removable basket 30 can be formed from other materials without extending beyond the scope of present disclosure.

Figure 5:
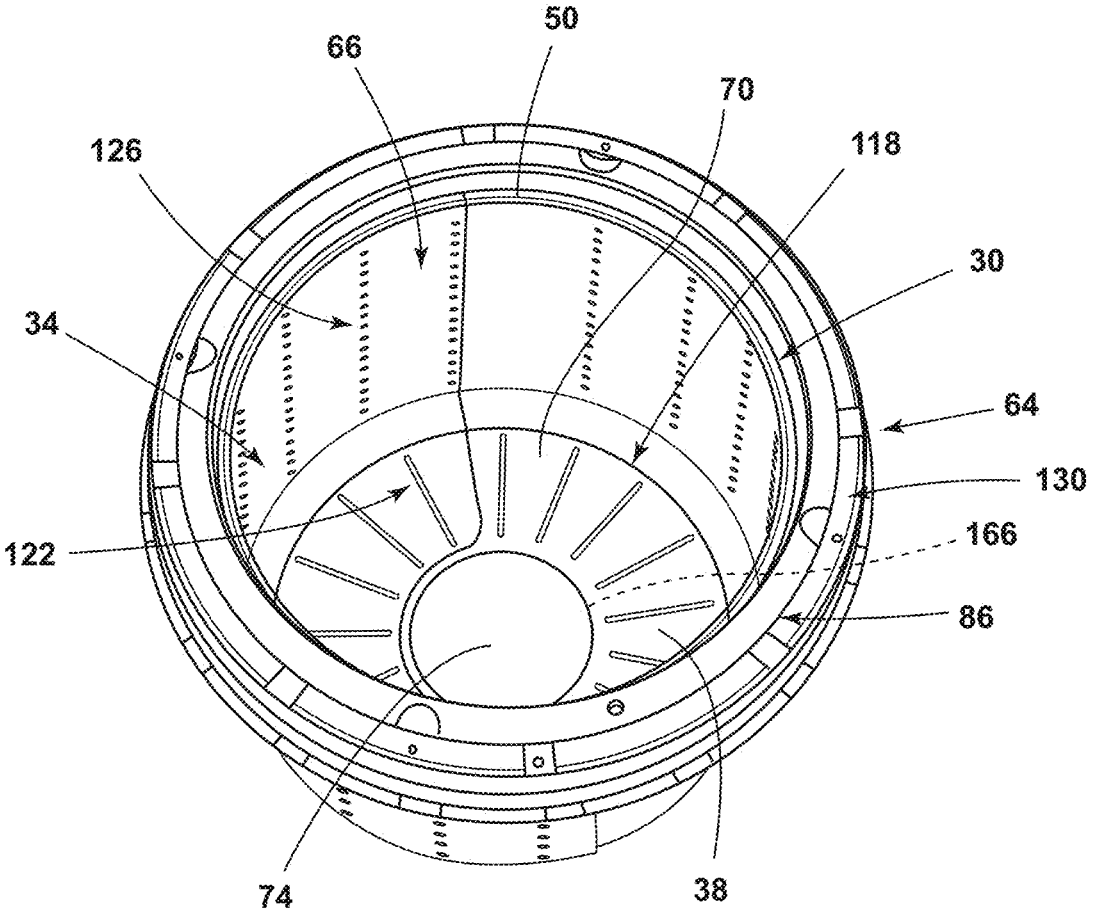
FIG. 5 is a top perspective view of a removable basket, according to at least one example.

Referring to FIG. 5, the removable basket 30 is illustrated coupled to the attachment feature 86 in the expanded position 64. In the depicted example, the second arcuate body 38 includes a coupling projection 124 that surrounds the entirety of a circumference of the center support 74, such that the second arcuate body 38 can be rotated about the center support 74. It is contemplated that the first arcuate body 34 can be coupled to the center support 74 in a similar manner. In such examples, the first arcuate body 34 is coupled to the center support 74 with the second arcuate body 38 positioned therebetween. In various examples, the center support 74 can be detached from the first and/or second arcuate bodies 34, 38.

In various examples, the base 70 of the removable basket 30 can define at least one slit 118. The slit 118 is configured to allow the fluids to flow therethrough between the removable basket 30 and the drum 26 (FIG. 1) positioned below for filling and draining fluids relative to the removable basket 30. The base 70 may define at least one ridge 126 configured to cooperate with one of the slits 118. In such examples, the ridge 126 interlocks into the slit 118 thereby fastening the first and second arcuate bodies 34, 38 together in a desired position. The desired position could be the nested position 60 (FIG. 2), the expanded position 64, or an intermediate position therebetween. In the depicted example, the sidewall 66 of the removable basket 30 defines the aperture 122. The aperture 122 is configured to allow fluids to flow therethrough between the removable basket 30 and the drum 26 below (e.g., a flow aperture 122).

Figure 6:
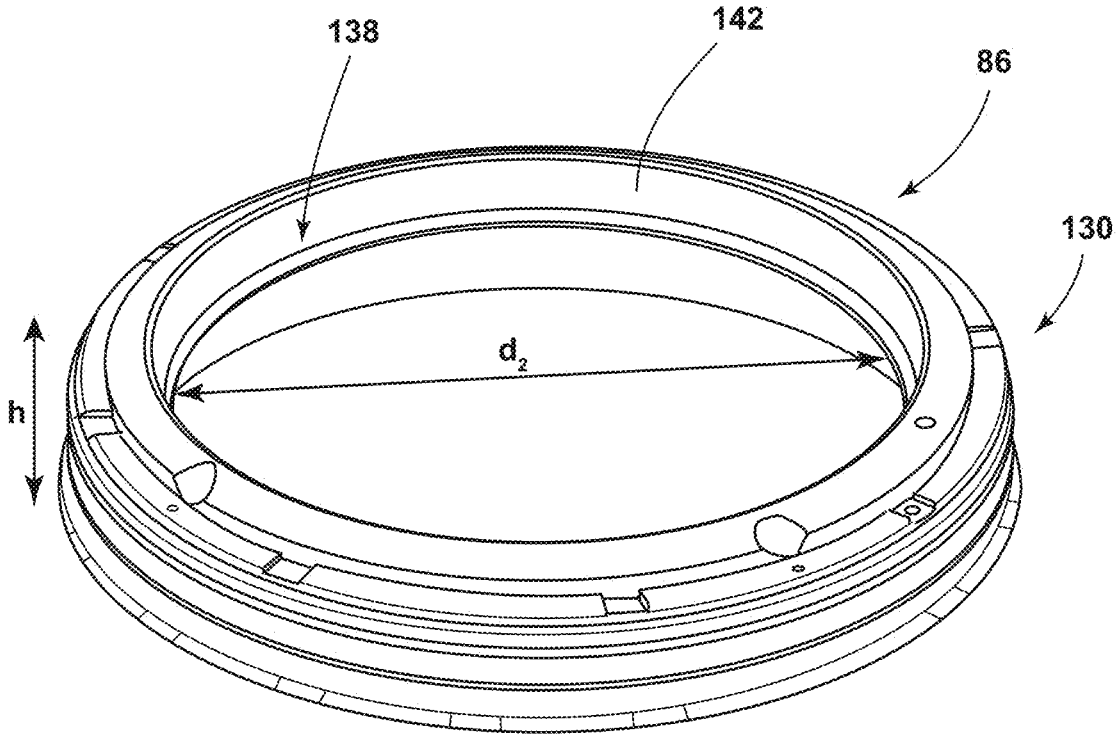
FIG. 6 is a side perspective view of an attachment feature for an aspect of a removable basket, according to at least one example.

Referring now to FIGS. 1, 5, and 6, as explained previously, the lip 50 of each of the first and second arcuate bodies 34, 38 is selectively coupled to the attachment feature 86. In various examples, the attachment feature 86 can be an attachment ring 130 extending around a circumference of the drum 26 and coupled to the upper portion 90 of the drum 26. The attachment ring 130 extends from an inner surface 134 of the drum 26. Additionally or alternatively, the attachment ring 130 may be coupled to a top edge of the drum 26 and positioned between the drum 26 and the top panel 22 of the cabinet 14 of the laundry appliance 10. In examples with the attachment ring 130, the attachment ring 130 includes a flange 138 extending from an inward surface 142 of the attachment ring 130. The flange 138 extends a distance, a shape, and/or an angle sufficient for the lip 50 to at least rest upon and typically securely couple to the attachment ring 130. The engagement between the lip 50 and the flange 138 secures and retains the removable basket 30 on the attachment ring 130 during the laundry cycle. The attachment ring 130 is typically configured to provide stability for the removable basket 30 during the laundry. In a non-limiting example, the attachment ring 130 has an inner diameter $d_2$ in a range of from about 300 mm to about 500 mm and a height h in a range of from about 200 mm to about 300 mm. In the depicted example, the attachment ring 130 has a diameter $d_2$ of about 425 mm and a height h of about 250 mm. It is contemplated that the size and/or dimensions of the attachment ring 130 differ based on the size and/or model of the laundry appliance 10. Accordingly, the sizes of the components of the removable basket 30 and the attachment feature 86 vary depending upon the size and/or configuration of the particular laundry appliance 10. The flange 158 can include various retaining features to rotationally hold the removable basket 30 in place during rotation of the drum 26.

Figure 7:
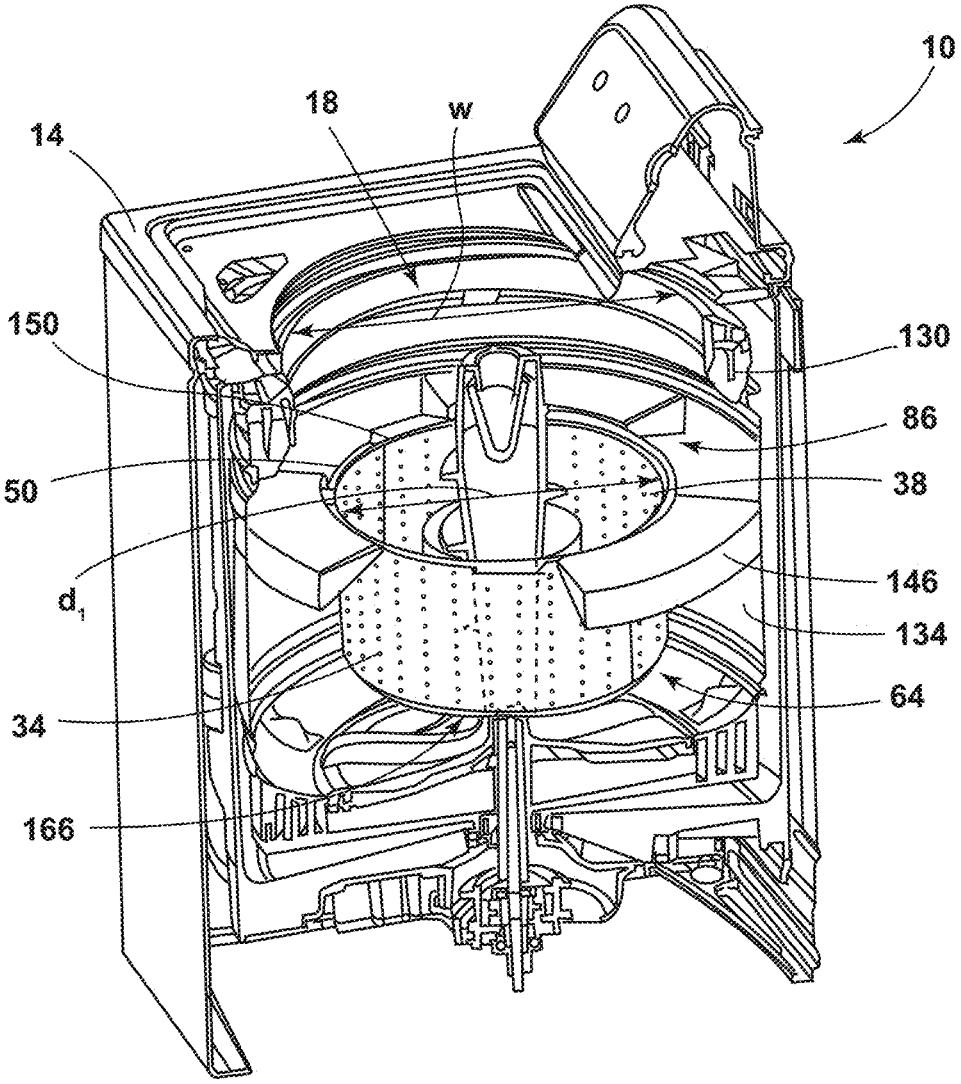
FIG. 7 is a cross-sectional view of a laundry appliance and a removable basket in an expanded position, according to at least one example.
Figure 8:
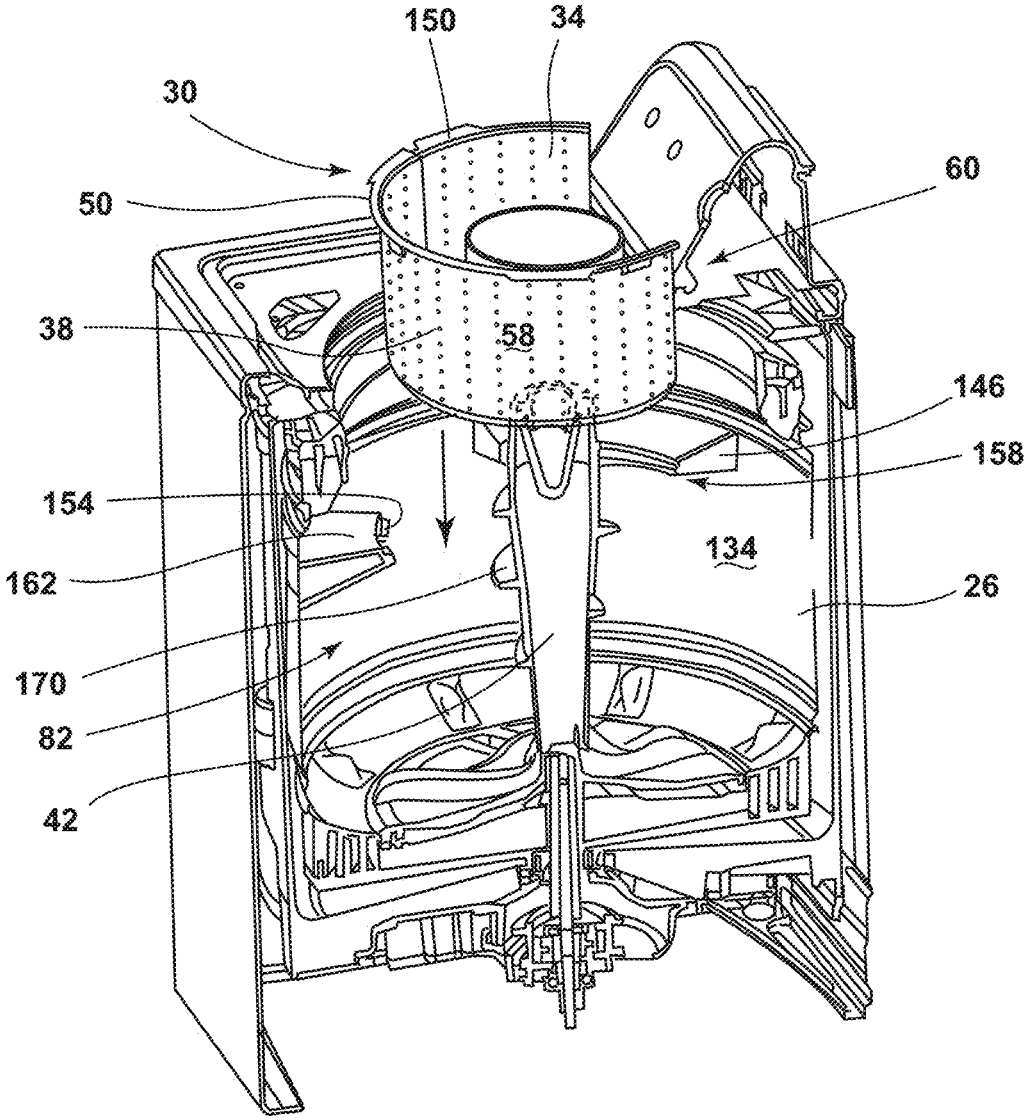
FIG. 8 is a cross-sectional view of a laundry appliance and a removable basket in a nested position, according to at least one example.

Referring to FIGS. 7 and 8, in various examples, the attachment feature 86 may include at least one bracket 146 extending from the inner surface 134 of the drum 26. The bracket 146 can be fixedly and/or removably coupled to the inner surface 134 of the drum 26. In such examples, the lip 50 typically extends varying distances outward from the first and second arcuate bodies 34, 38, such that the lip 50 defines at least one projection 150. The projection 150 extends outwardly from the exterior surface 58 of the removable basket 30 and is configured to cooperate with the bracket 146.

As shown in FIG. 8, the bracket 146 can include at least one protrusion 154 configured to cooperate with the lip 50 and/or the projection 150 of the removable basket 30. In various examples, the projection 150 and protrusion 154 interlock to secure the removable basket 30 to the bracket 146. Additionally, the bracket 146 may define a channel 158 along an interior edge 162 configured to cooperate with the lip 50 and/or the projection 150 of the first and second arcuate bodies 34, 38. In such examples, the projection 150 of the lip 50 is configured to slide and/or rotate into the channel 158 defined by the bracket 146 to secure the removable basket 30 within the drum 26. In various examples, the channel 158 is configured to receive the projection 150 and/or the lip 50 of the second arcuate body 38 as the second arcuate body 38 is rotated from the nested position 60 to the expanded position 64.

Still referring to FIGS. 7 and 8, in various examples, the diameter $d_1$ of the removable basket 30 is typically lesser than the width w of the opening 18 defined by the cabinet 14 of the laundry appliance 10. In such examples, the user inserts the removable basket 30 through the opening 18 and into the interior 82 of the drum 26 when the removable basket 30 is in the nested position 60 and/or the expanded position 64. The user can couple both the first and second arcuate bodies 34, 38 to the bracket 146 simultaneously. Alternatively, the user can couple the first arcuate body 34 to the bracket 146 and then couple the second arcuate body 38 to the bracket 146 by rotating the second arcuate body 38 into the expanded position 64. In various non-limiting examples, the volume of the removable basket 30 when the diameter $d_1$ is lesser than the width w is in a range of from about 0.25 cubic feet to about 0.75 cubic feet. In such non-limiting examples, the diameter $d_1$ is in a range from about 100 mm to about 200 mm and the width w is in a range of from about 300 mm to about 400 mm.

It is contemplated that the attachment feature 86 can include both the attachment ring 130 and the bracket 146. It may be advantageous to include both the attachment feature 86 and the bracket 146 to secure the removable basket 30 and different heights within the drum 26. In such examples, the attachment ring 130 and/or the bracket 146 may be removable so as not to interfere with the removable basket 30. In various examples, the attachment feature 86 can be formed from the same and/or similar materials as the drum 26 and/or the removable basket 30. In such examples, the attachment feature 86 may be formed from, for example, plastics, metals, and/or metal alloys.

With further reference to FIGS. 7 and 8, the removable basket 30 may not include the center support 74 (FIG. 2). Alternatively, the center support 74 can be removable from the first and second arcuate bodies 34, 38. In such examples, the removable basket 30 defines a hole 166 (also shown in FIG. 5) configured to accommodate the first agitator 42. The first agitator 42 can be extendable and/or configured to telescope upwards into the interior 82 of the drum 26. The first agitator 42 may also be formed of more than one component, such that additional components can be added to extend the first agitator 42 and/or provide convenient use of the removable basket 30 with the extended first agitator 42. Where the center support 74 is removed or otherwise not present, the first and second arcuate bodies 34, 38 surround the first agitator 42. In various examples, the first and second arcuate bodies 34, 38 can be coupled to the first agitator 42, such that the first agitator 42 rotates the drum 26 and/or the removable basket 30 as a single unit during the laundry cycle. The first agitator 42 typically includes at least one helical thread 170 extending from the first agitator 42. It is advantageous for the user to insert the removable basket 30 into the drum 26 in the nested position 60 and rotate the second arcuate body 38 around the first agitator 42 so the helical thread 170 can extend from the first agitator 42 without substantially interfering with the shape of the removable basket 30. The helical thread 170 can include an interruption that engages the removable basket 30 at the hole 166.

Figure 9:
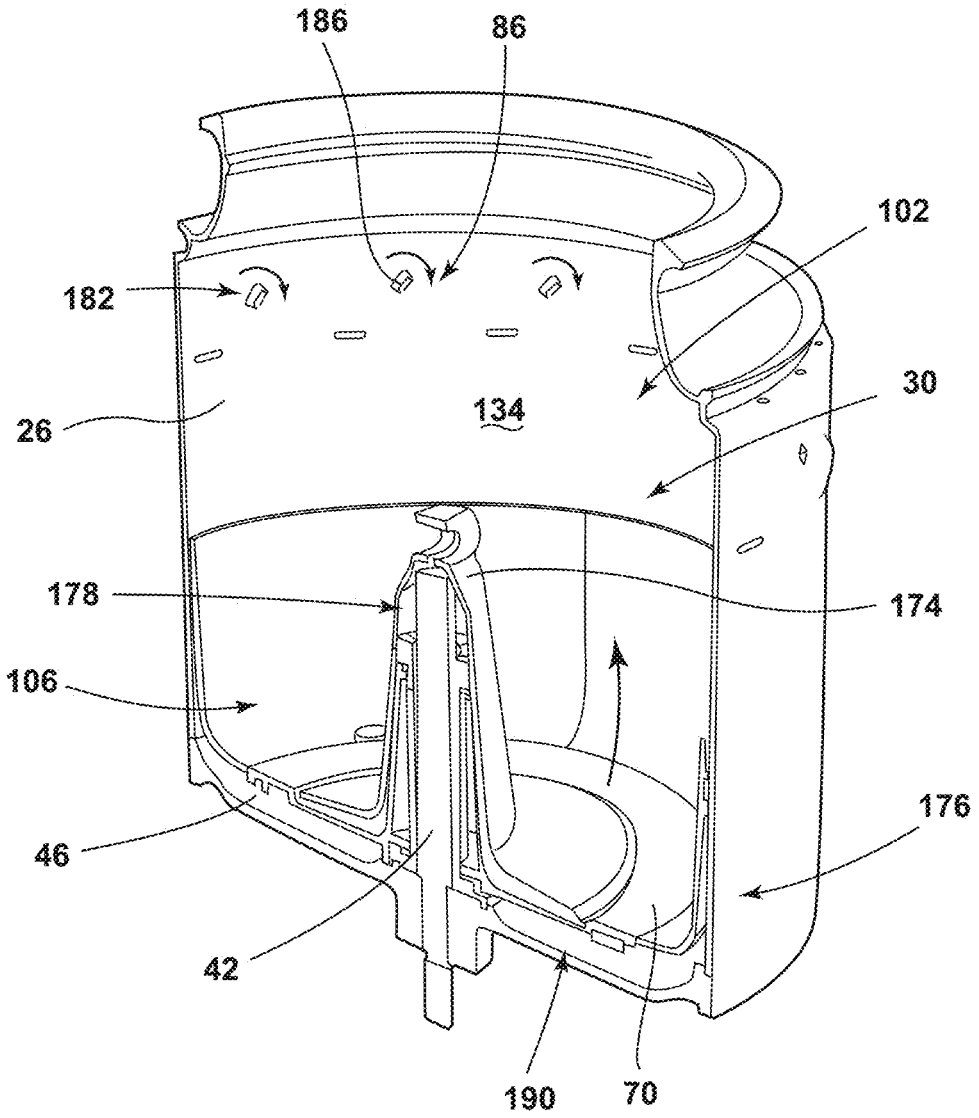
FIG. 9 is a cross-sectional view of a drum and a removable basket in a lowered position, according to at least one example.

Referring now to FIG. 9, the base 70 of the removable basket 30 can include a second agitator 174. The second agitator 174 is configured to be positioned over and/or coupled to the first agitator 42, such that the first and second agitators 42, 174 operate as a single unit. In such examples, the removable basket 30 is selectively positionable in a lowered position 176. Stated differently, the first agitator 42 is coupled to, or proximate to, the bottom surface 46 of the drum 26 and the second agitator 174 is coupled to, or proximate to, the bottom portion 106 of the removable basket 30. The first and second agitators 42, 174 are selectively coupled together to rotate as one unit. Accordingly, the second agitator 174 is typically substantially hollow and has a shape that is substantially congruent with the first agitator 42. In this way, the second agitator 174 defines a chamber 178 to selectively receive the first agitator 42. In various examples, the base 70 of the removable basket 30 is disposed on the bottom surface 46 of the drum 26 when in the lowered position 176, such that there can be a single space 102 to hold laundry. In such examples, the first agitator 42 is positioned entirely within the chamber 178 defined by the second agitator 174 so the removable basket 30 and the drum 26 can rotate as a single unit.

Figure 10:
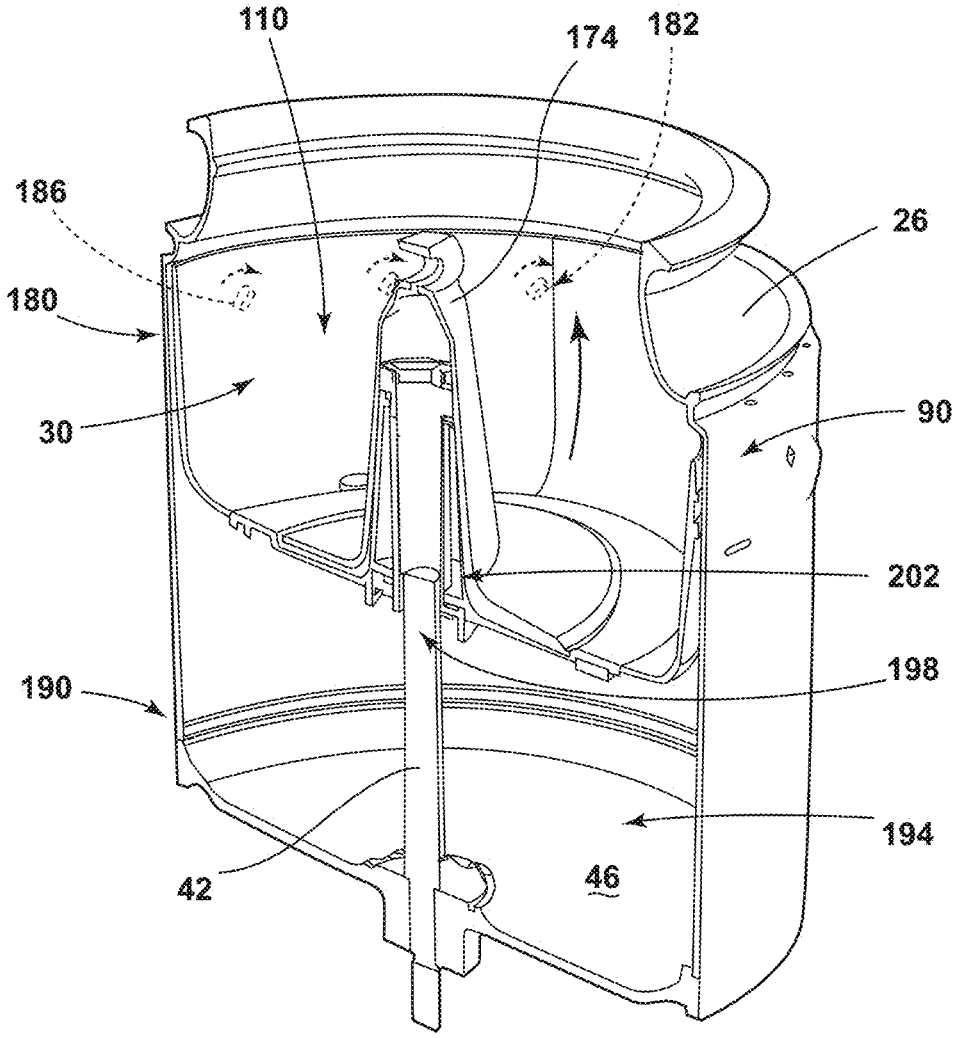
FIG. 10 is a cross-sectional view of a drum and a removable basket in a raised position, according to at least one example.

Referring to FIGS. 9 and 10, the removable basket 30 can be selectively coupled to the upper portion 90 of the drum 26 by the attachment feature 86. Accordingly, the removable basket 30 can be utilized in a raised position 180. When in the raised position 180, the removable basket 30 provides for upper and lower process regions for washing and/or drying laundry simultaneously. Additionally or alternatively, the removable basket 30 in the raised position 180 provides for a smaller cavity 110 compared to the single larger space 102 formed when the removable basket 30 is in the lowered position 176, which is advantageous for washing and/or drying a smaller load of laundry. In this way, the removable basket 30 can be utilized in the lowered position 176 and provide for a single larger space 102 within the drum 26 to wash and/or dry laundry. In various examples, the attachment feature 86 includes a first latching assembly 182 having at least one rotatable tab 186 that extends from the inner surface 134 of the drum 26. The rotatable tab 186 is operable between a retaining position and a releasing position. In various examples, the rotatable tab 186 can be operable between an oblique position (e.g., the retaining position) and a horizontal position (e.g., the releasing position). Alternatively, the rotatable tab 186 can be operable between a first oblique position and a second oblique position.

In operation, the rotatable tab 186 is configured to couple the removable basket 30 to the drum 26 and/or configured to assist the user in lowering the removable basket 30 downward into the drum 26. When positioned in the retaining position, the rotatable tab 186 secures the removable basket 30 in place. The user can lift the removable basket 30 towards the top panel 22 (FIG. 4) of the laundry appliance 10 (FIG. 1), which allows the rotatable tab 186 to rotate to the releasing position. In such examples, as the user releases the removable basket 30, the rotatable tab 186 positioned at the releasing position guides the removable basket 30 past the rotatable tab 186 and downward into the drum 26. Stated differently, the removable basket 30 is coupled to the upper portion 90 of the drum 26 by the rotatable tab 186, and the rotatable tab 186 rotates in the first direction 80A to release the removable basket 30 and rotates in a second direction to latch the removable basket 30 to the upper portion 90 of the drum 26.

Additionally or alternatively, the rotatable tab 186 can passively and/or automatically operate based upon upward/downward force applied to the removable basket 30 by the user. For example, when the user lifts the removable basket 30 upwards, the rotatable tab 186 can automatically move from the retaining position to the releasing position. In additional examples, the rotatable tab 186 may rotate to the releasing position when a downward force is applied to the removable basket 30. Further, a second latching assembly 190 can secure the removable basket 30 to the bottom surface 46 of the drum 26 and/or in the lowered position 176. It is contemplated that the distance the user moves the removable basket 30 before the removable basket 30 can be lowered past the rotatable tab 186 may differ based on the size of the removable basket 30 and/or the model of the laundry appliance 10.

To reattach the removable basket 30 to the upper portion 90 of the drum 26, the user can move the removable basket 30 upwards toward the top panel 22 of the laundry appliance 10 and place the removable basket 30 on the rotatable tab 186. The rotatable tab 186 rotates from the releasing position to the retaining position, thereby securing the removable basket 30 to the drum 26. Stated differently, the removable basket 30 can be selectively coupled to the upper portion 90 and a lower portion 194 of the drum 26 by the first and second latching assemblies 182, 190.

In various examples, the removable basket 30 is selectively coupled to the upper portion 90 of the drum 26 to create at least two spaces to accommodate laundry. In such examples, an interior edge portion 198 of the first agitator 42 can be configured to cooperate with and/or be coupled to a bottom edge portion 202 of the second agitator 174. Coupling the first and second agitators 42, 174 when the removable basket 30 is coupled to the upper portion 90 of the drum 26 allows the first and second agitators 42, 174 to operate as a single unit. This arrangement allows the removable basket 30 and the drum 26 to rotate as a single unit.

Figure 11:
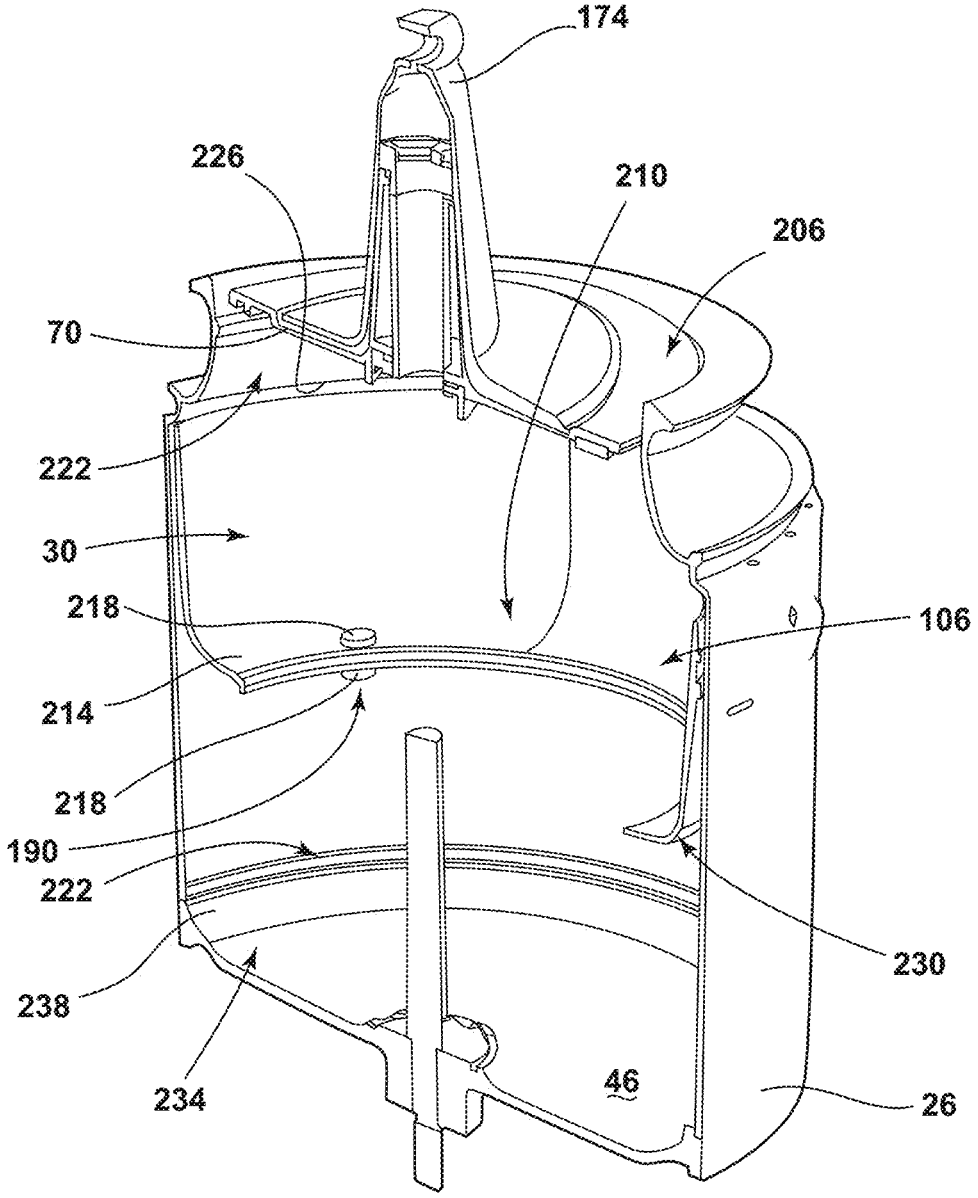
FIG. 11 is a cross-sectional view of a drum and an aspect of a removable basket having a removable base, according to at least one example.
Figure 12:
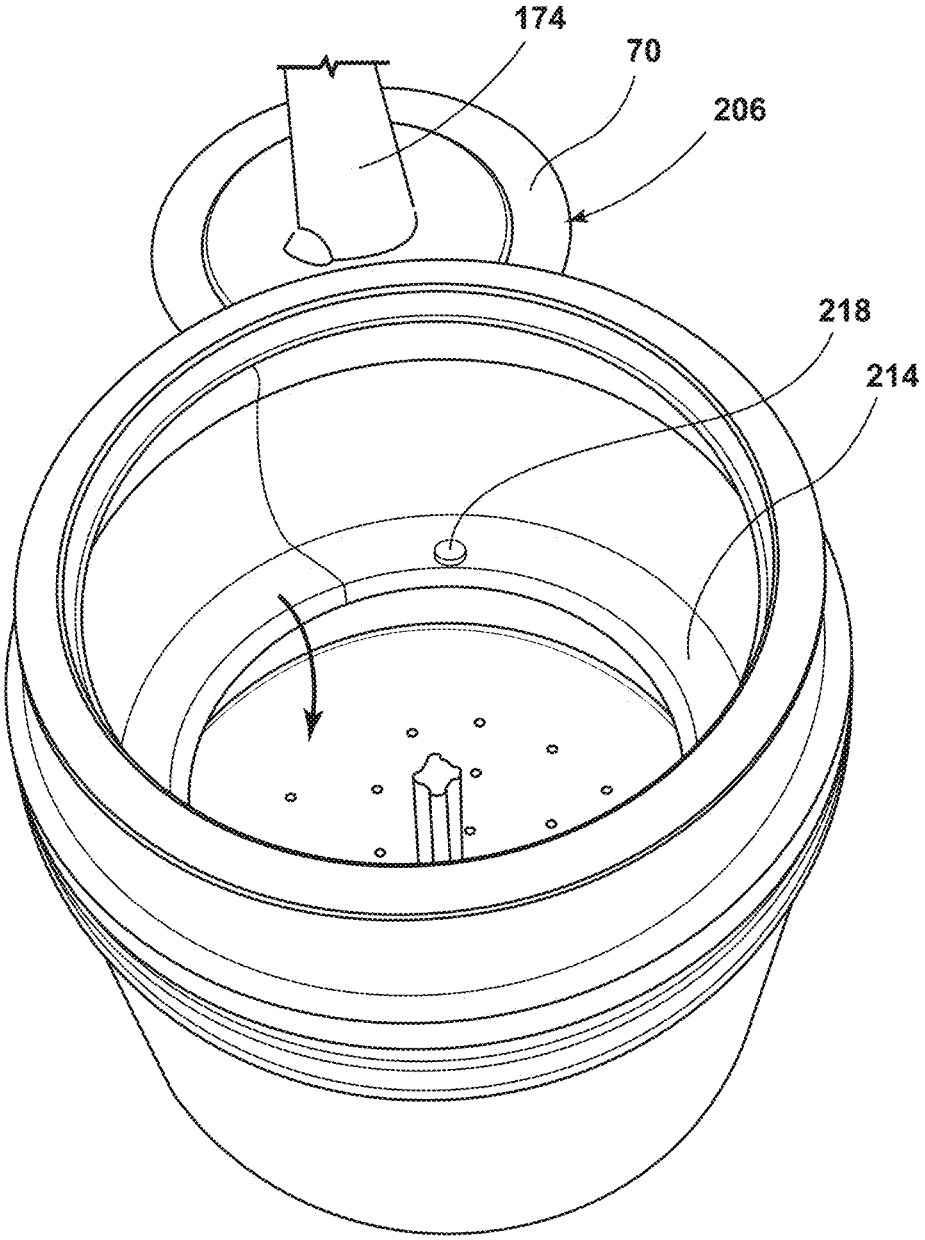
FIG. 12 is a top perspective view of a removable basket having a removable base, according to at least one example.

Referring to FIGS. 11 and 12, the second agitator 174 can be integrally defined by the base 70 of the removable basket 30. In various examples, the base 70 is removable. In such examples, an outer edge portion 206 of the base 70 interlocks with the bottom portion 106 of the removable basket 30. The bottom portion 106 of the removable basket 30 typically curves inward toward a center portion 210 of the removable basket 30 to create a platform 214 for supporting the base 70. Stated differently, each of the first and second arcuate bodies 30, 34 define a respective platform 214. The platforms 214 each include a protuberance 218 configured to cooperate with pockets 222 defined by a lower surface 226 of the base 70. The protuberances 218 form an interlocking fit with the pockets 222. Stated differently, the base 70 coupled with the second agitator 174 is selectively coupled to an outside edge portion 230 of the removable basket 30.

The removable base 70 allows the user to conveniently lower the removable basket 30 to the lowered position 176 and use the removable basket 30 and drum 26 as a single unit. In such examples, an outward edge portion 234 of the bottom surface 46 of the drum 26 typically includes a raised portion 238 to support the platform 214 of the removable basket 30. In this way, the amount of space between the removable basket 30 and the drum 26 is minimized and the usable space for processing laundry is maximized. The second latching assembly 190 can retain the removable basket 30 in the lowered position 176. In non-limiting examples, the removable basket 30 can include an additional protuberance 218 that extends downward from the platform 214. In such examples, the outward edge portion 234 of the bottom surface 46 of the drum 26 can define at least one pocket 222 configured to cooperate with the protuberance 218. Accordingly, the protuberance 218 and the pocket 222 on the bottom surface 46 of the drum 26 can form an interference fit to secure the removable basket 30 to the drum 26. It is contemplated that the removable basket 30 can include the removable base 70 and/or the second agitator 174 in combination with the first and second arcuate bodies 34, 38 (FIG. 1).

Figure 13:
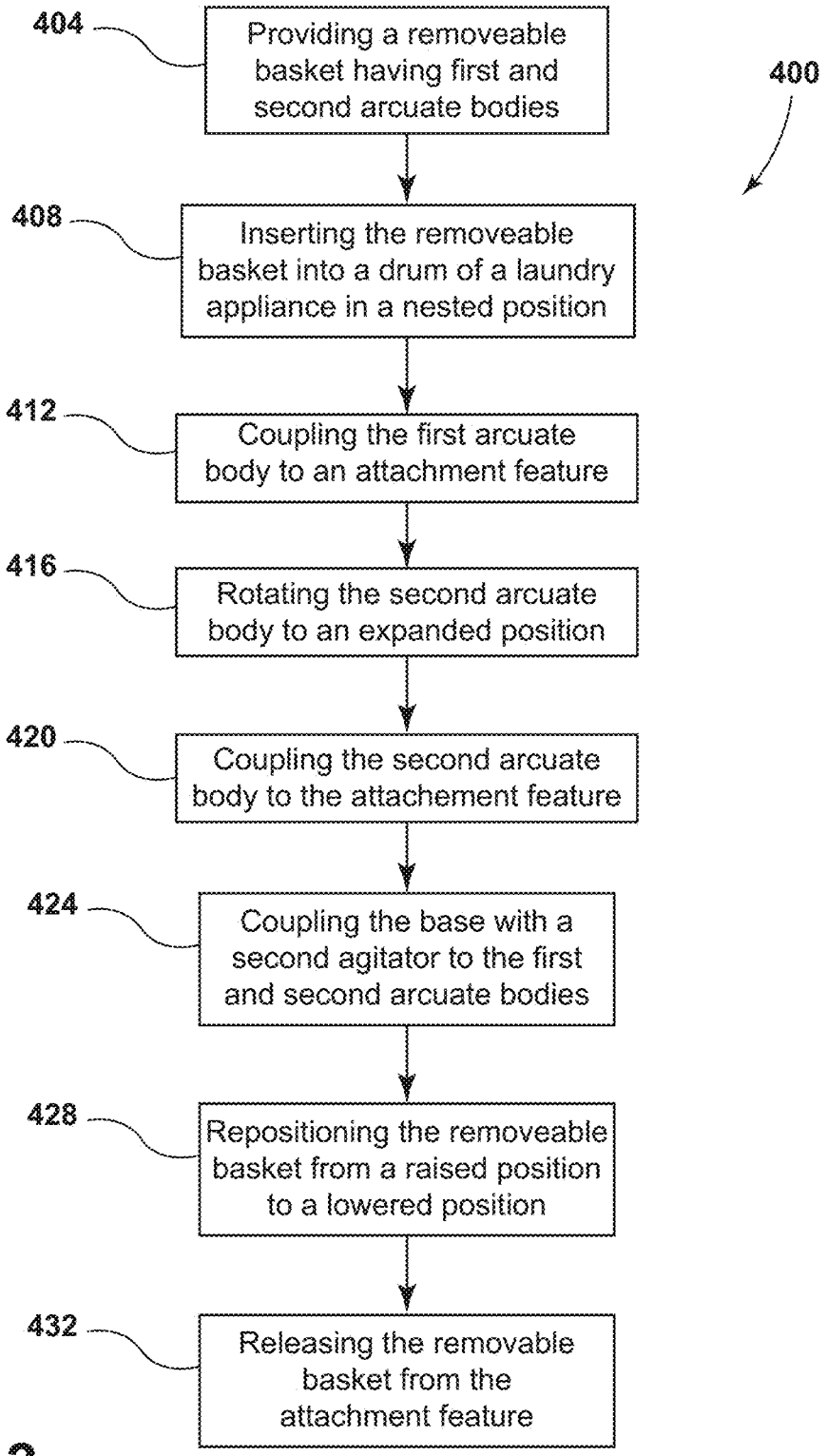
FIG. 13 is a flowchart diagram of a method of installing a removable basket into a laundry appliance, according to at least one example.

Referring to FIG. 13, a method 400 for installing the removable basket 30 in the laundry appliance 10 is provided. Step 404 includes providing the removable basket 30 that has the first and second arcuate bodies 34, 38. Step 408 includes inserting the removable basket 30 into the drum 26 of the laundry appliance 10. The removable basket 30 is typically inserted into the drum 26 when the removable basket 30 is in the nested position 60. The removable basket 30 can be coupled to the drum 26 in one of the lowered position 176 and the raised position 180 depending on the selection of the user.

In step 412, the first arcuate body 34 is coupled to the attachment feature 86. The attachment feature 86 can be the attachment ring 130, the bracket 146, and/or the rotatable tab 186. The lip 50 of the first arcuate body 34 is received, rests upon, and/or is otherwise retained by the attachment feature 86.

In step 416, the second arcuate body 38 is rotated, such that the removable basket 30 is in the expanded position 64. In various examples, the second arcuate body 38 slidably engages the center support 74 to rotate between the nested and expanded positions 60, 64. Moreover, the exterior surface 58 of the second arcuate body 38 at least partially overlaps the interior surface 62 of the first arcuate body 34, at least when the removable basket 30 is in the nested position 60. When the removable basket 30 is in the nested position 60, the first and second arcuate bodies 34, 38 typically substantially overlap to provide for convenient insertion into the drum 26 through the opening 18. However, it is contemplated that the first and second arcuate bodies 34, 38 can at least partially overlap when in the expanded position 64 to form the continuous sidewall 66.

In step 420, the second arcuate body 38 is coupled to the attachment feature 86. The lip 50 and/or the projection 150 can rest upon, be received, or otherwise engage the attachment feature 86. When rotated to the expanded position 64, the second arcuate body 38 is fastened and/or locked with the first arcuate body 34, typically via the retaining assembly 94.

In step 424, the base 70 that includes the second agitator 174 is coupled to the first and second arcuate bodies 34, 38. The protuberances 218 of the first and second arcuate bodies 34, 38 form an interference fit with the pockets 222 of the base 70 to retain the base 70 on the first and second arcuate bodies 34, 38. In step 424, the second agitator 174 can be coupled to the first agitator 42 to allow the removable basket 30 to rotate with the drum 26.

In step 428, the removable basket 30 can be repositioned from the raised position 180 to the lowered position 176 or vice versa. The removable basket 30 is selectively coupled to the drum 26 proximate the upper portion 90. In this way, the removable basket 30 can be assembled and disassembled at the upper portion 90 of the drum 26. Further, the removable basket 30 is selectively coupled proximate the bottom surface 46 of the drum 26. The bottom surface 46 may include the raised portion 238 and/or additional protuberances 218 to support and/or engage the removable basket 30. In this way, the removable basket 30 is retained on the bottom surface 46 during the laundry cycle.

In step 432, the removable basket 30 is released from the attachment feature 86 and is repositioned from the raised position 180 to the lowered position 176 by a force of gravity. In various examples, the attachment feature 86 is configured as the rotatable tab 186 that rotates between the retaining and releasing positions. The user can lift the removable basket 30 from the rotatable tab 186 and release the removable basket 30. Once released from the grasp of the user, the removable basket 30 typically lowers by the force of gravity toward the lowered position 176. The rotatable tab 186 rotates automatically or by a force from the removable basket 30 to the releasing position. In the releasing position, the rotatable tab 186 guides the removable basket 30 as the removable basket 30 lowers within the drum 26. To reassemble the removable basket 30 with the rotatable tab 186, the user can lift the removable basket 30 and place the lip 50 on the rotatable tab 186. The rotatable tab 186 rotates to the retaining position in response to the force of the removable basket 30 being placed thereon.

Use of the present disclosure provides a variety of advantages. For example, the removable basket 30 includes the first and second arcuate bodies 34, 38 to provide convenient insertion and/or removal of the removable basket 30. Conventional secondary drums are formed as a single unit, which often require a large opening 18 in the laundry appliance 10. Additionally, the first and second arcuate bodies 34, 38 of the present disclosure are operable between nested and expanded positions 60, 64. The removable basket 30 positioned within the drum 26 in the nested position 60 allows a user to reach laundry within the drum 26 without removing the removable basket 30. Conventional appliances using a lower drum and an upper drum often require the upper drum to be removed before a user can access laundry in the lower drum. Further, the removable basket 30 can be stored within the laundry appliance 10 by lowering the removable basket 30 to the bottom surface 46 of the drum 26, such that the removable basket 30 and the drum 26 can act as a single unit. Conventional upper drums typically must be stored at an external location compared to the laundry appliance 10 when not in use. Additional benefits or advantages of using this device may also be realized and/or achieved.

According to at least one aspect of the present disclosure, a laundry appliance includes a cabinet that defines an opening to access an interior. A drum is positioned within the interior of the cabinet. A removable basket is selectively coupled to the drum and includes a first arcuate body that is coupled with a second arcuate body. The second arcuate body is rotatable between a nested position and an expanded position.

According to another aspect, a removable basket is selectively coupled to an upper portion of the drum by an attachment feature.

According to another aspect, a attachment feature includes a latching assembly having one or more rotatable tabs configured to rotate between a retaining position and a releasing position.

According to another aspect, a diameter of the removable basket in an expanded position is greater than a width of an opening of a cabinet.

According to another aspect, an exterior surface of a second arcuate body overlaps an interior surface of a first arcuate body at least when a removable basket is in a nested position.

According to another aspect, a removable basket is operable between a raised position and a lowered position within an interior of a drum.

According to another aspect, a first agitator is coupled to a bottom surface of a drum and a second agitator is coupled to first and second arcuate bodies. The second agitator defines a chamber to receive the first agitator when a removable basket is in a lowered position.

According to another aspect, a bottom portion of a removable basket is disposed on a bottom surface of a drum when in a lowered position.

According to another aspect, an agitator is coupled to a bottom surface of a drum. A removable basket defines a hole between first and second arcuate bodies to selectively receive the agitator when the removable basket is disposed within an interior of the drum.

According to another aspect of the present disclosure, a removable basket for a laundry appliance includes a first arcuate body. A base is coupled to the first arcuate body. A second arcuate body is rotatably coupled to the first arcuate body. The second arcuate body rotates between a nested position and an expanded position. A fastening assembly is coupled to at least one of the first and second arcuate bodies to retain the second arcuate body in the expanded position.

According to another aspect, a second arcuate body includes a coupling projection that extends around a center support coupled to a base. The coupling projection slidably engages the center support as the second arcuate body rotates between a nested position and a expanded position.

According to another aspect, first and second arcuate bodies each define a platform that has a respective protuberance. A base is selectively disposed on the platform and defines pockets to receive the respective protuberances to couple the base to the first and second arcuate bodies.

According to another aspect, a base defines an agitator.

According to another aspect, a bottom portion of at least one of the first and second arcuate bodies defines a slit.

According to another aspect, a sidewall of at least one of the first and second arcuate bodies defines a flow aperture.

According to another aspect, an exterior surface of a second arcuate body abuts an interior surface of a first arcuate body at least when in a nested position.

According to another aspect of the present disclosure, a method for installing a removable basket within a laundry appliance includes providing a removable basket having a first arcuate body rotatably coupled to a second arcuate body. The removable basket is inserted into a drum when the removable basket is in a nested position. The first arcuate body is coupled to an attachment feature. The second arcuate body is coupled to the attachment feature.

According to another aspect, a removable basket is repositioned from a raised position proximate an upper portion of a drum to a lowered position proximate a bottom surface of the drum.

According to another aspect, a base that has an agitator is coupled to the first and second arcuate bodies.

According to another aspect, a removable basket is released from an attachment feature. The removable basket is repositioned from a raised position to a lowered positon by a force of gravity.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A laundry appliance, comprising:

a cabinet defining an opening to access an interior;

a drum positioned within the interior of the cabinet;

a first agitator coupled to a bottom surface of the drum;

a removable basket selectively coupled to the drum and operable between a raised position and a lowered position within an interior of the drum, wherein the removable basket includes:

a first arcuate body; and a second arcuate body coupled with the first arcuate body, wherein the second arcuate body is rotatable about a rotational axis of the removable basket between a nested position in which the second arcuate body overlaps the first arcuate body for insertion into the drum and an expanded position in which the first arcuate body and the second arcuate body form a substantially continuous sidewall to hold laundry; and a second agitator coupled to the first and second arcuate bodies, wherein the second agitator defines a chamber to receive the first agitator when the removable basket is in the lowered position.

2. The laundry appliance of claim 1, wherein the removable basket is selectively coupled to an upper portion of the drum by an attachment feature.

3. The laundry appliance of claim 2, wherein the attachment feature includes a latching assembly having one or more rotatable tabs configured to rotate between a retaining position and a releasing position.

4. The laundry appliance of claim 1, wherein a diameter of the removable basket in the expanded position is greater than a width of the opening of the cabinet.

5. The laundry appliance of claim 1, wherein an exterior surface of the second arcuate body overlaps an interior surface of the first arcuate body at least when the removable basket is in the nested position.

6. The laundry appliance of claim 1, wherein a bottom portion of the removable basket is disposed on the bottom surface of the drum when in the lowered position.

7. The laundry appliance of claim 1, wherein the removable basket defines a hole between the first and second arcuate bodies to selectively receive the first agitator when the removable basket is disposed within an interior of the drum.

8. The laundry appliance of claim 7, wherein an interior edge portion of the first agitator is coupled to a bottom edge portion of the second agitator when the removable basket is in the raised position.

9. The laundry appliance of claim 1, wherein the first agitator is selectively coupled to the second agitator to rotate as a single unit.

10. The laundry appliance of claim 1, wherein said laundry appliance includes an upper space within the removable basket and a lower space below the removable basket when the removable basket is in the raised position.

11. The laundry appliance of claim 1, wherein the removable basket is coupled to an upper portion of the drum in the raised position by a rotatable tab.

12. The laundry appliance of claim 11, wherein the rotatable tab is configured to rotate in a first direction to release the removable basket from the upper portion and is configured to rotate in a second direction to latch the removable basket to the upper portion.

13. The laundry appliance of claim 1, further comprising:

a latching assembly configured to couple the removable basket to a bottom surface of the drum when the removable basket is in the lowered position.

14. The laundry appliance of claim 1, wherein the second agitator is integrally formed with a base of the removable basket.

15. The laundry appliance of claim 14, wherein an outer edge portion of the base is configured to interlock with a bottom portion of the removable basket.

16. The laundry appliance of claim 1, wherein the bottom portion of each of the first arcuate body and the second arcuate body is curved to form a platform for supporting the base.

17. The laundry appliance of claim 1, further comprising:

a retaining assembly coupled to the removable basket to secure the first arcuate body and the second arcuate body in the expanded position.

18. The laundry appliance of claim 17, wherein the retaining assembly is configured to secure the first arcuate body and the second arcuate body in the nested position.

19. The laundry appliance of claim 1, wherein a single space is defined to receive laundry when the removable basket is in the lowered position.

20. The laundry appliance of claim 1, wherein the rotational axis of the removable basket aligns with a rotational axis of the drum when the removable basket is in the expanded position.

* * * * *